US006062343A

United States Patent [19]

Wang

[11] Patent Number: 6,062,343

[45] **Date of Patent: *May 16, 2000**

[54] APPARATUS FOR CONTROLLING DATA TRANSMITTING/RECEIVING OF GROUP MANAGEMENT SYSTEM OF ELEVATOR AND METHOD USING THE SAME

[75] Inventor: Kwang Sik Wang, Kyungsangnam-Do, Rep. of Korea

[73] Assignee: LG Industrial System Co., Ltd., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,435

[22] Filed: Oct. 17, 1997

[30] Foreign Application Priority Data

Oct. 17, 1996 [KR] Rep. of Korea ..... 96-46448

[51] Int. Cl.[7] ..... B66B 1/28

[52] U.S. Cl. ..... 187/247; 187/380

[58] Field of Search ..... 187/380, 247, 187/248, 391, 393

[56] References Cited

U.S. PATENT DOCUMENTS

| | | | |
|---|---|---|---|
| 4,431,086 | 2/1984 | Moser et al. | 187/391 |
| 4,872,532 | 10/1989 | Tobita et al. | 187/247 |
| 5,357,064 | 10/1994 | Boyce et al. | 187/247 |
| 5,389,748 | 2/1995 | Burke et al. | 187/247 |
| 5,854,454 | 12/1998 | Upender et al. | 187/247 |

*Primary Examiner*—Jonathan Salata

[57] ABSTRACT

An apparatus for controlling data transmitting/receiving of the group management system of an elevator and a method using the same, which relates to decreasing a communication load factor of a system which transmits/receives data to/from a plurality of cages and a group management controller through a main network, for integrating data outputted from a plurality of hall controllers and outputting the integrated data to the group management controller or the plurality of cages through the main network, and integrating data outputted from the group management controller and outputting the integrated data to the plurality of hall controllers.

17 Claims, 8 Drawing Sheets

APPARATUS FOR CONTROLLING DATA TRANSMITTING/RECEIVING OF GROUP MANAGEMENT SYSTEM OF ELEVATOR AND METHOD USING THE SAME

BACKGROUND OF THE INVENTION

1. Field of the Invention

The present invention relates to controlling data transmission/receiving of a group management system of an elevator, and in particular to an improved apparatus for controlling data transmitting/receiving of the group management system of the elevator and a method using the same, capable of integrating data which are transmitted/received to/from a group management controller and a hall controller, and transmitting the integrated data at a time, thereby decreasing a communication load factor.

2. Description of the Conventional Art

FIG. 1 is a diagram illustrating a conventional apparatus for controlling data transmitting/receiving of a group management system of an elevator.

As shown therein, the conventional apparatus includes: a plurality of cages 2A–2K; a group management controller 1 for managing and controlling the operation of the cages 2A–2K; a plurality of hall controllers 4A–4N and 5A–5N for controlling buttons and lamps of each hall; first and second amplifiers 3A and 3B for amplifying data outputted from the hall controllers 4A–4N and 5A–5N, and transmitting the amplified data to the group management controller 1 or the plurality of cages 2A–2K through a main network NETm. The hall controllers 4A–4N which are connected with the first amplifier 3A include a first hall line 4, and the hall controllers 5A–5N which are connected with the second amplifier 3B include a second hall line 5.

The operation of the conventional apparatus for controlling data transmitting/receiving of the group management system of the elevator will be described.

The group management controller 1 synthetically manages the operation of the plurality of cages 2A–2K, and when a hall call is generated in the hall (not illustrated), the group management controller 1 decides which cage among the cages 2A–2K is in the best state for servicing on the basis of an information of the operation of the cage in accordance with the hall call, then selects, and operates the corresponding cage.

A data according to a hall call which is generated in the first hall line 4 is amplified at a predetermined level by a first amplifier 3A, and a data which is generated in the second hall line 5 is amplified at a predetermined level by a second amplifier 3B. The data which are amplified by the first and second amplifiers 3A and 3B are transmitted to the group management controller 1 or the cages 2A–2K through the main network NETm. Here, the main network NETm is connected with the group management controller 1 and the cages 2A–2K for a data communication. When data receiving/transmitting is performed through the main network NETm, the number of a node of the main network NETm which leads the data communication in a certain cycle is determined by "the number of the group management controller+the number of the cage+the number of the hall controller".

Namely, that is the maximum number of the node which affects the communication of the main network NETm in the certain cycle.

For example, when the numbers of the group management controller, the cages, the hall lines, and the floor where the cages are operating are 1, 4, 3, and 64, respectively, the number of the nodes which may use the main network NETm are 1+4+(3*64)=197. Here, if an extra group management controller for backing up the operation is added, the number of the nodes is 198.

If an extra hall line having a plurality of hall controllers is added, the number of the nodes are 2+4+(3*64)=198+64=262.

As described above, the main factors which affects the number of the nodes are the number of the hall lines (3) and the number of the floors that the cages are operating (64). However, the number of the group management controllers and the number of the cages do not have an important effect on the number of the nodes.

Accordingly, in the conventional apparatus for controlling data transmitting/receiving of a group management system of an elevator, if a great number of nodes are simultaneously used in a certain cycle when the data transmitting/receiving is carried out via the main network NETm, the communication load factor of the main network is considerably increased, therefore the data communication is erroneously occurred and a system reliability is deteriorated.

Also, in order to decrease the communication load factor, the number of the hall lines and the number of the floors that the cages are operating should be limited.

SUMMARY OF THE INVENTION

Accordingly, it is an object of the present invention to provide an apparatus for controlling data transmitting/receiving of the group management system of an elevator and a method using the same, so that a stable data communication is possible without limiting the number of hall lines and the number of floors that cages are operating.

It is another object of the present invention to provide an apparatus for controlling data transmitting/receiving of the group management system of an elevator and a method using the same, capable of collectively processing data transmitted from a group management controller and a cage, and a data transmitted from a hall controller, thereby minimizing a time which a main network is occupied and decreasing a communication load factor.

To achieve the above objects, there is provided an apparatus for controlling data transmitting/receiving of the group management system of an elevator, comprising a plurality of cages, a group management controller for managing and controlling the operations of the plurality of cages, a plurality of hall controllers for controlling buttons and lamps of each hall, and a hall data integrating unit for integrating data outputted from the hall controllers for a predetermined cycle, then transmitting the integrated data to the group management controller and the plurality of cages through a main network, integrating data outputted from the group management controller and the plurality of cages for a predetermined cycle, and then transmitting the integrated data to the hall controllers through a sub network.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 10A and 10B are diagrams illustrating the structure of integrated data units, FIG. 10A illustrating an integrated data unit representing data received from plural hall controllers having similar attributes such as the data shown in FIG. 10, and FIG. 10B illustrating an integrated data unit representing data based on data for managing and controlling the plural elevator cages.

DETAILED DESCRIPTION OF THE INVENTION

Figure 1:
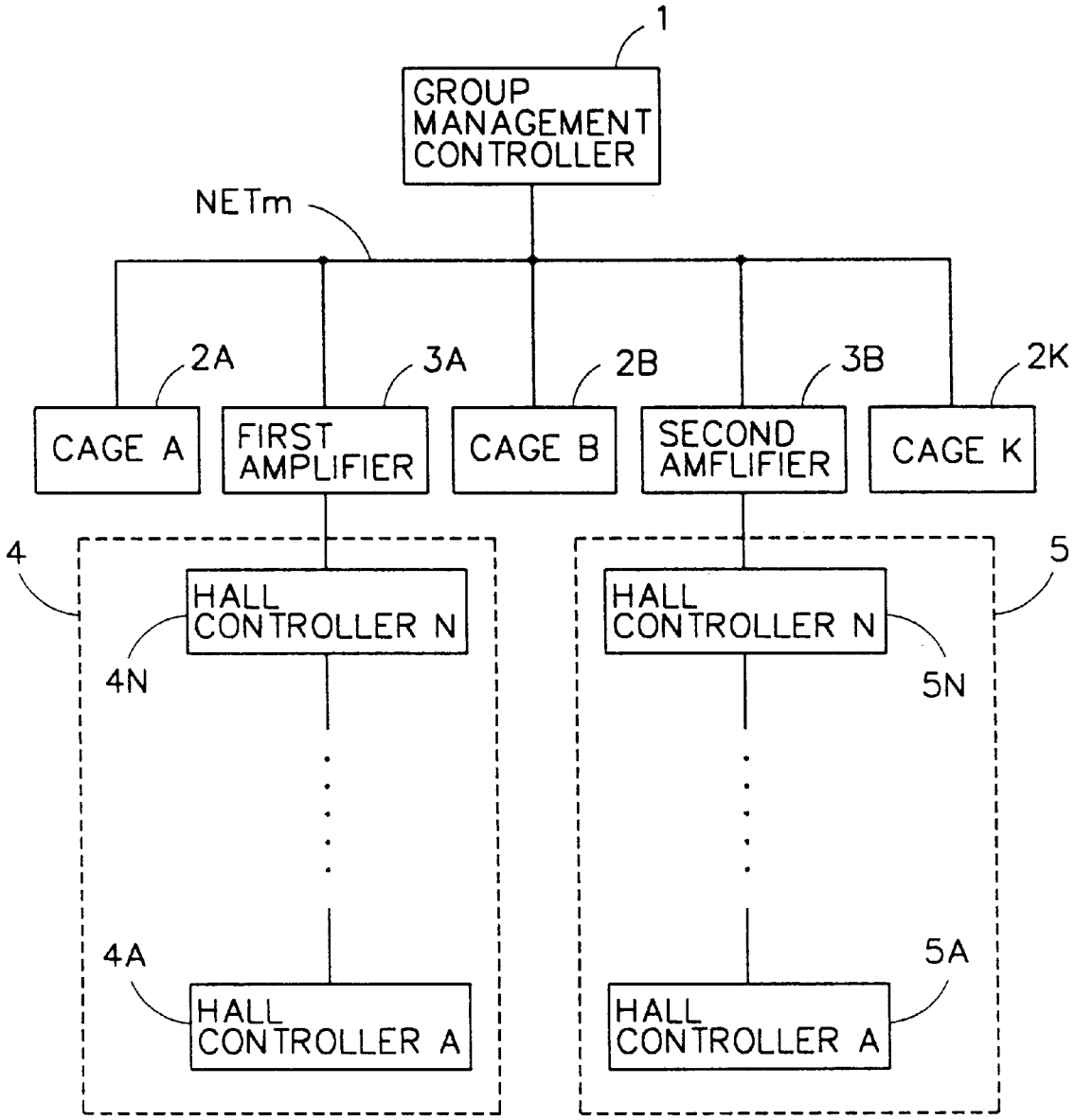
FIG. 1 CONVENTIONAL ART
FIG. 1 is a diagram illustrating a conventional apparatus for controlling data transmitting/receiving of a group management system of an elevator.
Figure 2:
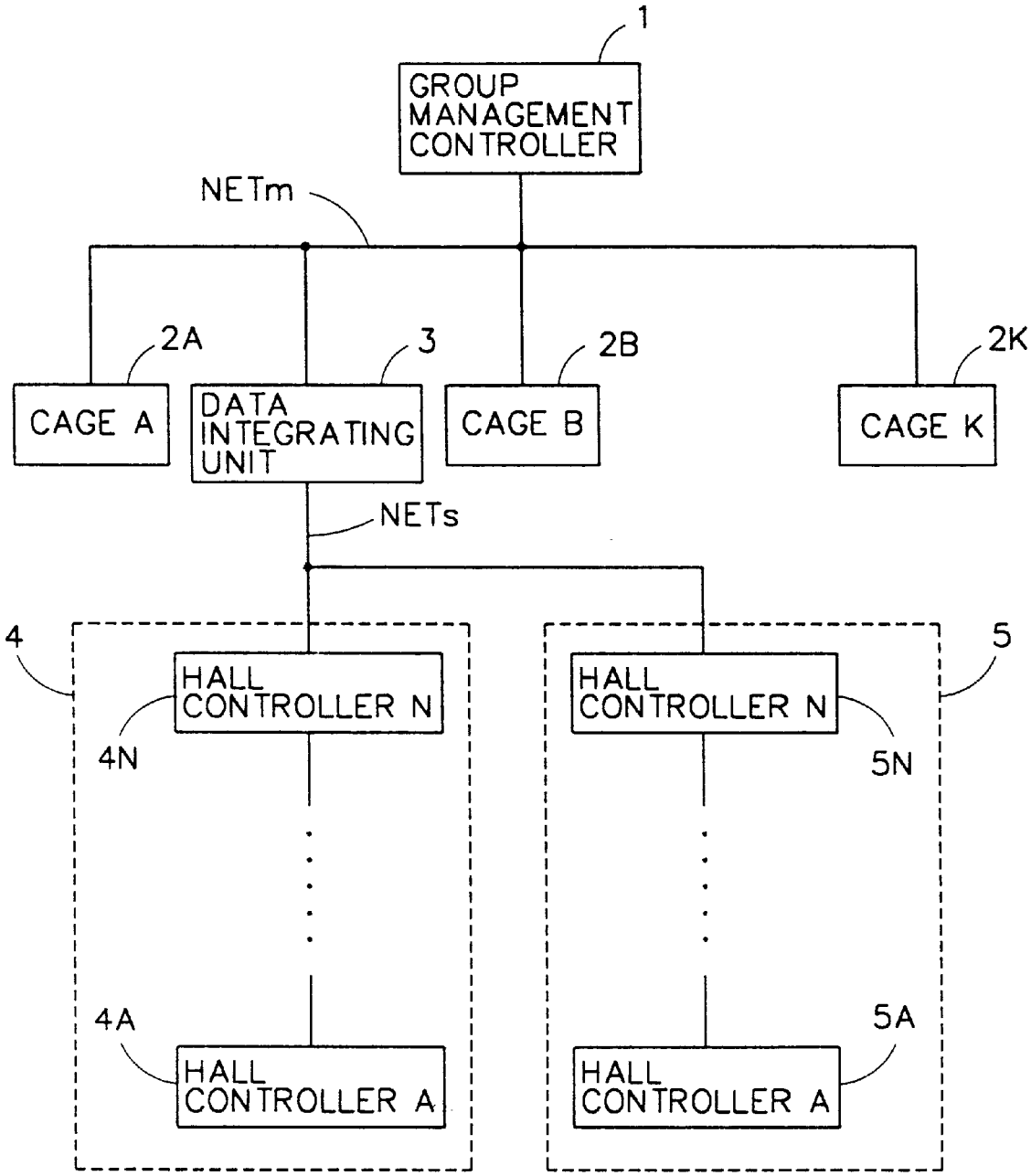
FIG. 2 is a diagram illustrating an embodiment of an apparatus for controlling data transmitting/receiving of a group management system of an elevator according to the present invention.

FIG. 2 is a diagram illustrating an embodiment of an apparatus for controlling data transmitting/receiving of a group management system of an elevator according to the present invention. As shown therein, the apparatus for controlling data transmitting/receiving of a group management system of an elevator includes a plurality of cages 2A–2K, a group management controller 1 for managing and controlling the operations of the plurality of cages 2A–2K, a plurality of hall controllers 4A–4N and 5A–5N for controlling buttons and lamps of each hall, and a hall data integrating unit 30 for integrating data outputted from the hall controllers 4A–4N and 5A–5N for a predetermined cycle, then transmitting the integrated data to the group management controller 1 and the plurality of cages 2A–2K through a main network NETm, integrating data outputted from the group management controller 1 and the plurality of cages 2A–2K for a predetermined cycle, and then transmitting the integrated data to the hall controllers 4A–4N and 5A–5N through a sub network NETs.

The main network NETm connects the group management controller 1 and the plurality of hall controllers 4A–4N and 5A–5N with the hall data integrating unit 30, and the sub network NETs connects the first and second hall lines 4 and 5 with the hall data integrating unit 30.

Figure 3:
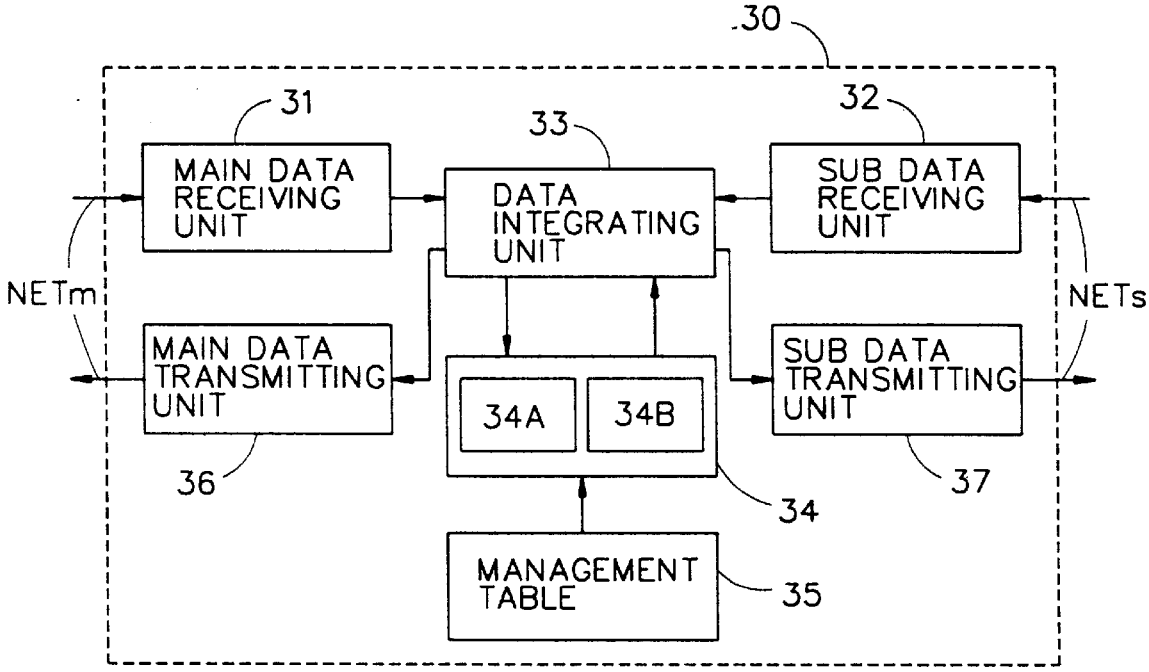
FIG. 3 is a diagram illustrating a hall data integrating unit of the apparatus according to the present invention of FIG. 2.

As shown in FIG. 3, the hall data integrating unit 30 includes: a main data receiving unit 31 for receiving data through the main network NETm; a sub data receiving unit 32 for receiving data through the sub network NETs; a data integrating unit 33 for integrating data received from the main and sub data receiving units 31 and 32; a receiving table 34 provided with a main receiving table 34A for storing data which is processed in the data integrating unit 33 after passing through the main data receiving unit 31 and a sub receiving table 34B for storing data which is processed in the data integrating unit 33 after passing through the sub data receiving unit 32; a management table 35 for storing an integrated cycle; a main data transmitting unit 36 for outputting the data stored in the sub receiving table 34B to the main network NETm; and a sub data transmitting unit 37 for outputting the data stored in the main receiving table 34A to the sub network NETs.

The operation of an embodiment of the apparatus for controlling data transmitting/receiving of a group management system of an elevator according to the present invention will be described.

When data outputted from the group management controller 1 and the plurality of cages 2A–2K are inputted to the hall data integrating unit 30 through the main network NETm and the main data receiving unit 31, and data outputted from the hall controllers 4A–4N and 5A–5N are inputted to the hall data integrating unit 30 through the sub network NETs and the sub data receiving unit 32, the hall data integrating unit 30 receives the inputted data and stores the data in the receiving table 34. The above operation will be described in detail with reference to FIG. 4.

Figure 4:
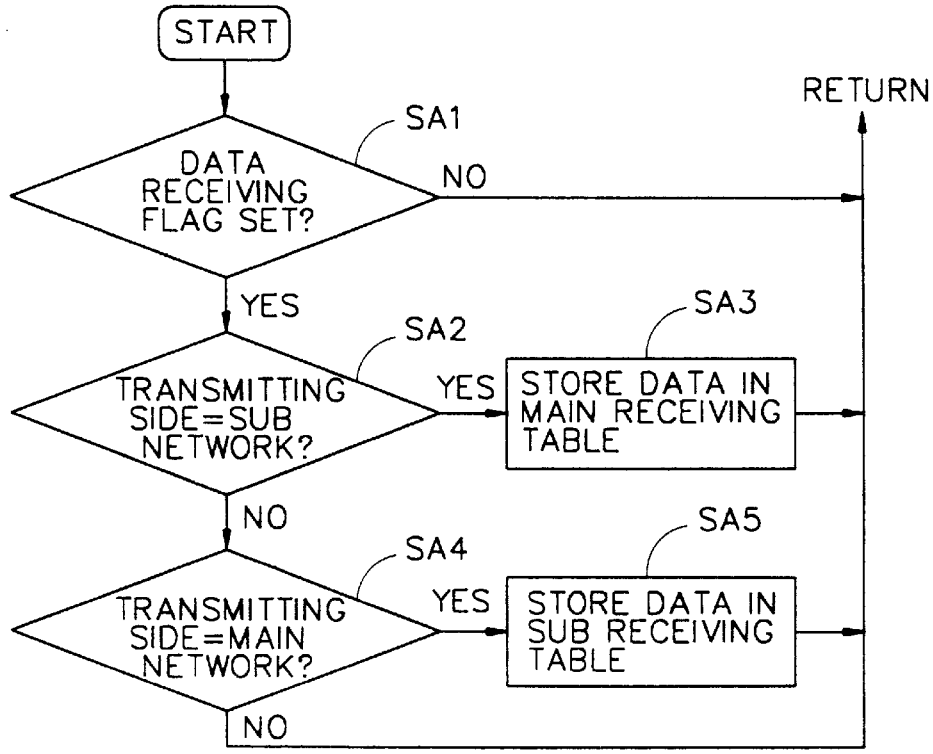
FIG. 4 is a flowchart illustrating data inputted to the hall data integrating unit of the apparatus according to the present invention are being stored in a receiving table.

FIG. 4 is a flowchart illustrating how data which is inputted to the hall data integrating unit 30 is stored in the receiving table 34.

The main or sub data receiving unit 31 or 32 checks whether a data receiving flag is set (SA1), here when the data receiving flag is set, it means that data is inputted to the corresponding receiving unit. If the data receiving flag is not set, the routine returns, and if the flag is set, that is, if the data is received, it is checked whether a transmitting side of the received data is the sub network NETs or the main network NETm (SA2) (SA4).

When the inputted data is outputted from the main network NETm, the inputted data is judged as a data which will be transmitted to the hall controllers 4A–4N and 5A–5N, thereby being stored in the main receiving table 34A (SA3). When the inputted data is outputted from the sub network NETs, the inputted data is judged as a data which will be transmitted to the group management controller 1 or the plurality of cages 2A–2K, thereby being stored in the sub receiving table 34B (SA5). (In addition, a size of each node is considered, and therefore a storage location of the table is determined in steps SA3 and SA5.)

Figure 5:
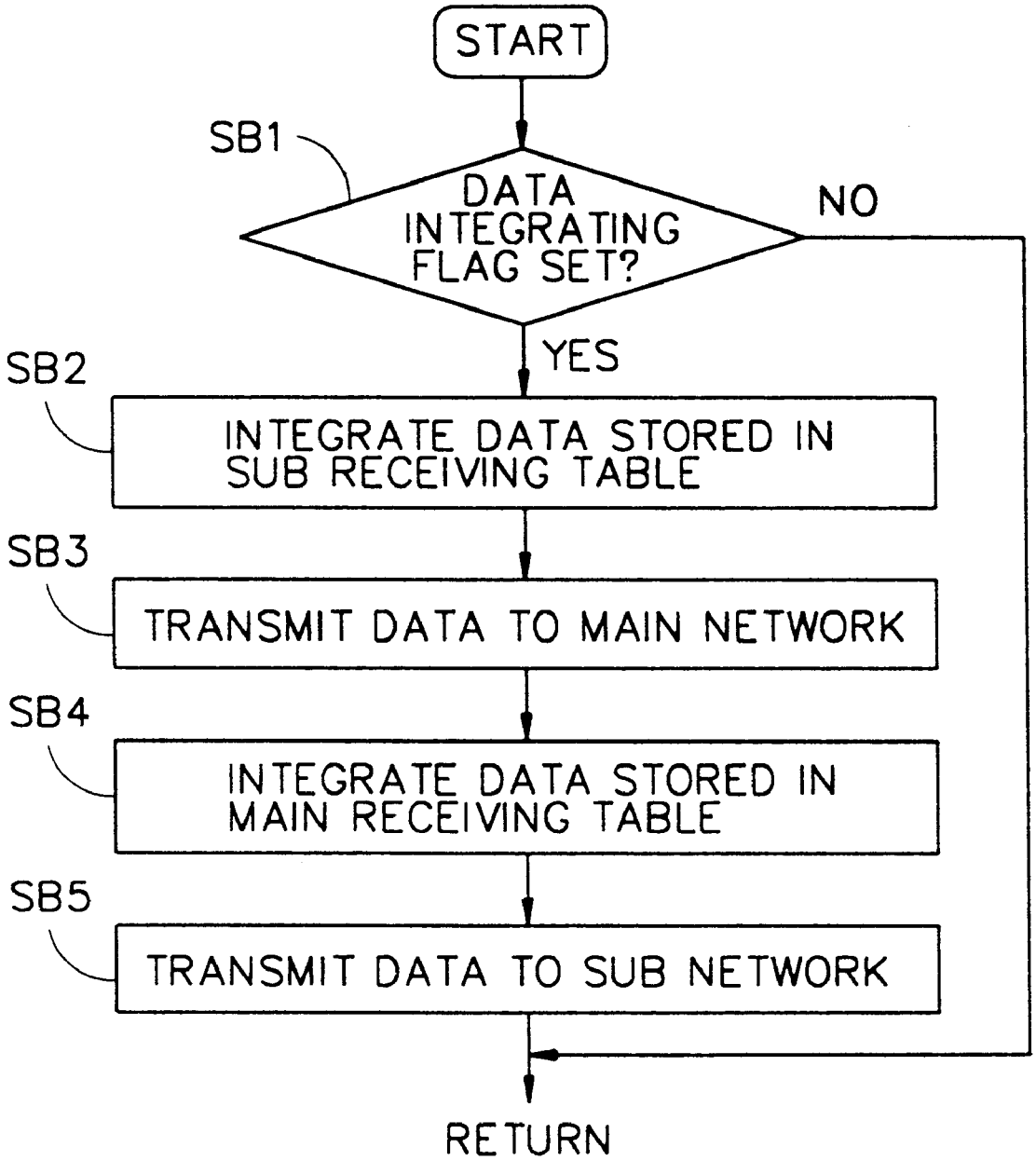
FIG. 5 is a flowchart illustrating integrated data is transmitted according to the present invention.

Next, with reference to FIG. 5, the process for integrating and outputting the received data will be described.

A data integrated cycle is preset in the management table 35, and whether the data integrating flag is set is checked (SB1), and if the data integrating flag is not set, the routine returns. If the data integrating flag is set, the data which are outputted from the hall controller 4A–4N or 5A–5N and stored in the sub receiving table 34B are integrated in a predetermined format, and transmitted to the main network NETm through the main data transmitting unit 36 (SB2) (SB3). Here, said format of the data will be later described.

With the same method as above described, the data which are outputted from the group management controller 1 or the cages 2A–2K and stored in the main receiving table 34A are integrated in a predetermined format and then transmitted to the hall controllers 4A–4N and 5A–5N through the sub network NETs (SB4,SB5). The format of communication record for transmitting the data will be described in detail with reference to FIG. 7.

Figure 7:
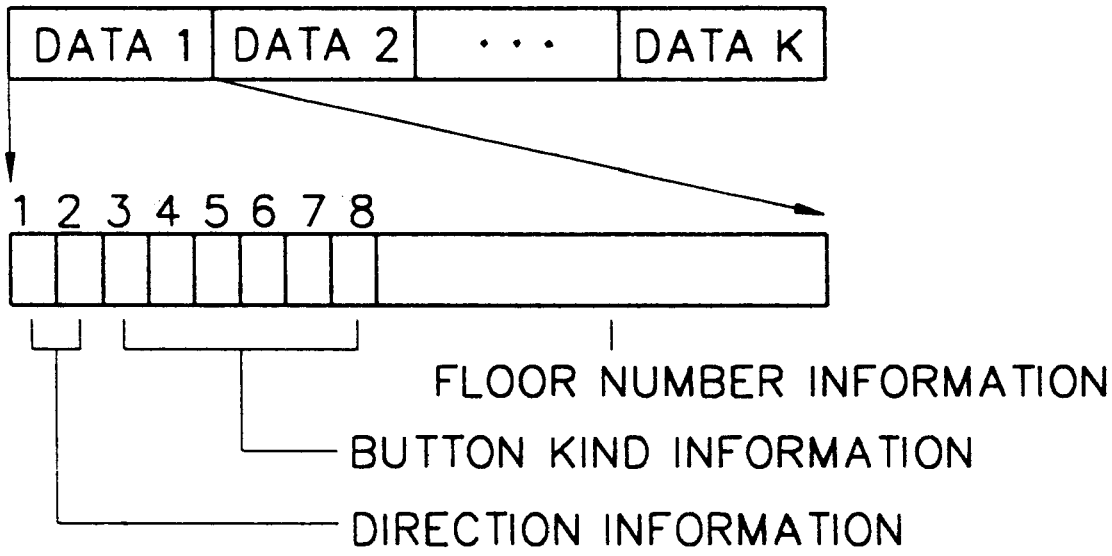
FIG. 7 is a diagram illustrating an embodiment of a format of a communication record according to the present invention.

FIG. 7 illustrates an embodiment of the format of communication record according to the present invention.

As shown therein, the format of the communication record of the main receiving table 34A and that of the sub receiving table 34B are identical.

The communication record stores data which are hall call information up to K, and the hall call information consists of "an operating direction of a cage", "a button kind of a cage", and "a floor number where a call is generated", etc.

Each data, the hall call information, consists of 2 bytes, and the first 1 byte consists of 8 bits. Here, 2 bits are for the operating direction of the cage, when the cage upwardly operates, the first bit becomes 1, and when the cage downwardly operates, the second bit becomes 1. The rest of 6 bits are for the button kind of the cage, and the second 1 byte is for storing the floor number where the call is generated.

Here, the button kind of the cage means a kind of a hall button which is installed in the hall. It means that various kinds of hall buttons may be installed. For example, a hall button may be installed at 1.5M above the ground for an ordinary person, or at 0.9M above the ground for a person using a wheel chair. In the specification, the kind of the hall buttons is distinguished into A and B.

The reason of distinguishing the button kind of the cage is that when using the cage, the ordinary person boards on the cage comparatively faster than the person on the wheel chair, therefore the control which is distinguished in accordance with the kind of the hall button is required.

Figure 8:
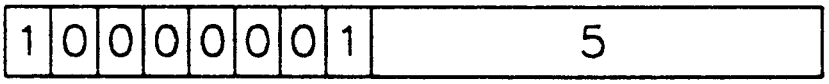
FIG. 8 is a diagram illustrating an embodiment of a data of the communication record according to the present invention.

FIG. 8 is a diagram illustrating a data of a communication record when a button A of the upward direction is pressed on the 5th floor.

Figure 6:
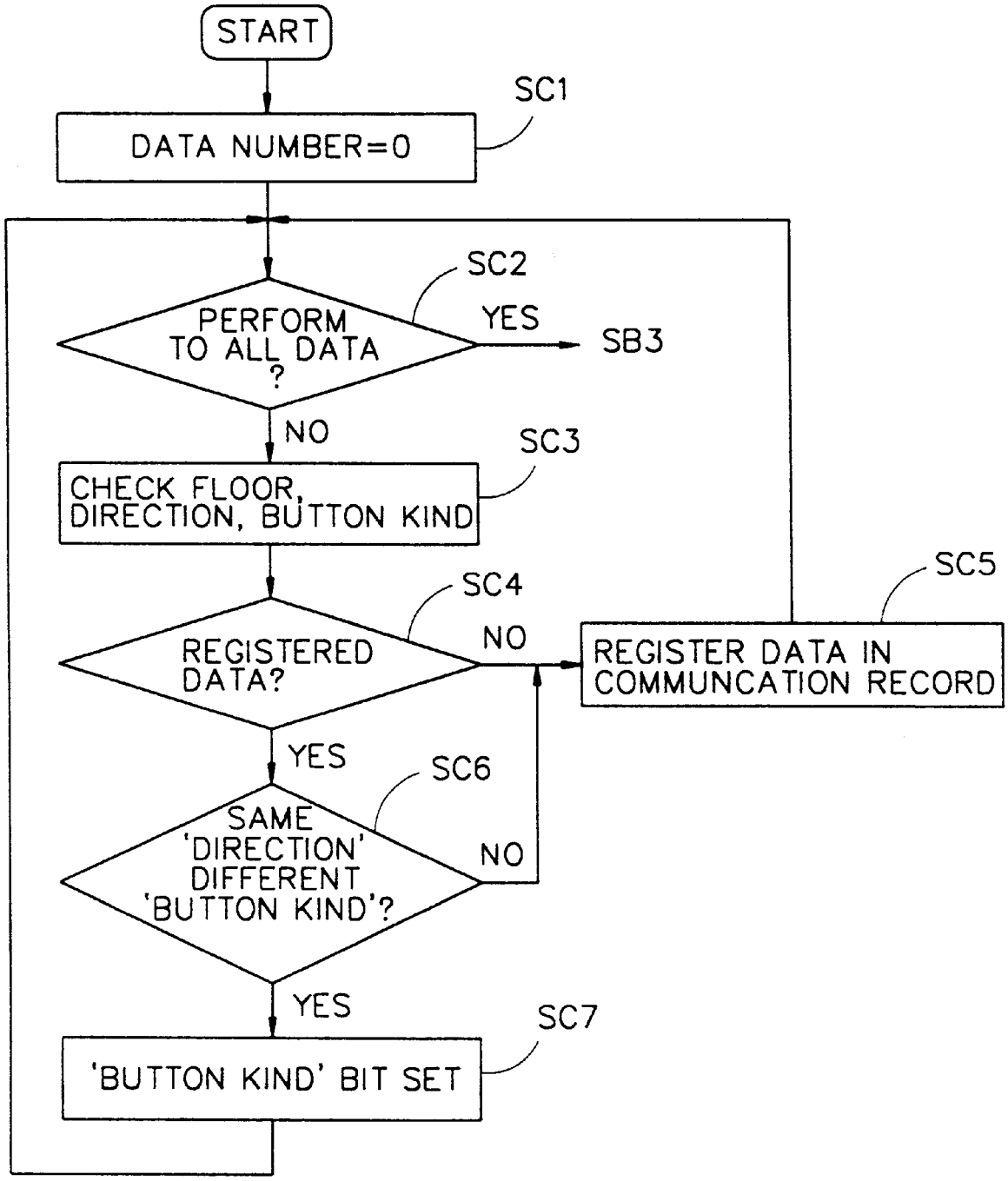
FIG. 6 is a flowchart illustrating data are integrated according to the present invention.

With reference to FIG. 6, the process for integrating the data received from the hall (SB2) of FIG. 5 will be described. In a first step (SC1), a data number is initialized in order to check the sub receiving table 34B. In a second step (SC2), if all the data of the sub receiving table 34B are integrated, it is returned to the step SB3 of FIG. 5, and if not, "the floor number of the cage", "the operating direction of the cage", and "the button kind of the cage" of the data which are currently analyzed are checked in a third step (SC3).

In a fourth step (SC4), whether the data is registered in the communication record is checked, and if not, as shown in a fifth step (SC5), the data is newly registered in the communication record in accordance with the data format of the communication record of FIG. 8.

On the other hand, as a result of checking in the fourth step (SC4), if the data is already registered, in a sixth step (SC6), it is judged whether "the operating direction" of the two data is identical and "the button kind" thereof is different, by comparing "the operating direction and button kind of the cage" of the data which is currently being analyzed and that of the data which is already registered. If satisfied, a new data is not generated, but only a bit with respect to "the button kind of the cage" is set on the registered data.

However, if not satisfied in the sixth step (SC6), the data which is being analyzed is registered in the communication record in the fifth step (SC5).

When an identical data is received from the hall, performing the fourth and fifth steps (SC4, SC5) can prevents the identical data from repeatedly being registered in the communication record, and reduces the size of the data. The above-described process will be described in more detail by using the following three assumptions.

Assumption 1) The number of maximum hall calls which can be generated within 200 ms are six.

Assumption 2) Four hall calls are generated, and each of the hall calls is a third floor-type A-upward direction (D1), a third floor-type B-upward direction (D2), a ninth floor-type A-upward direction (D3), and a twelfth floor-type A-downward direction (D4).

Assumption 3) It takes 10 ms to transmit/receive a single data.

Figure 9:
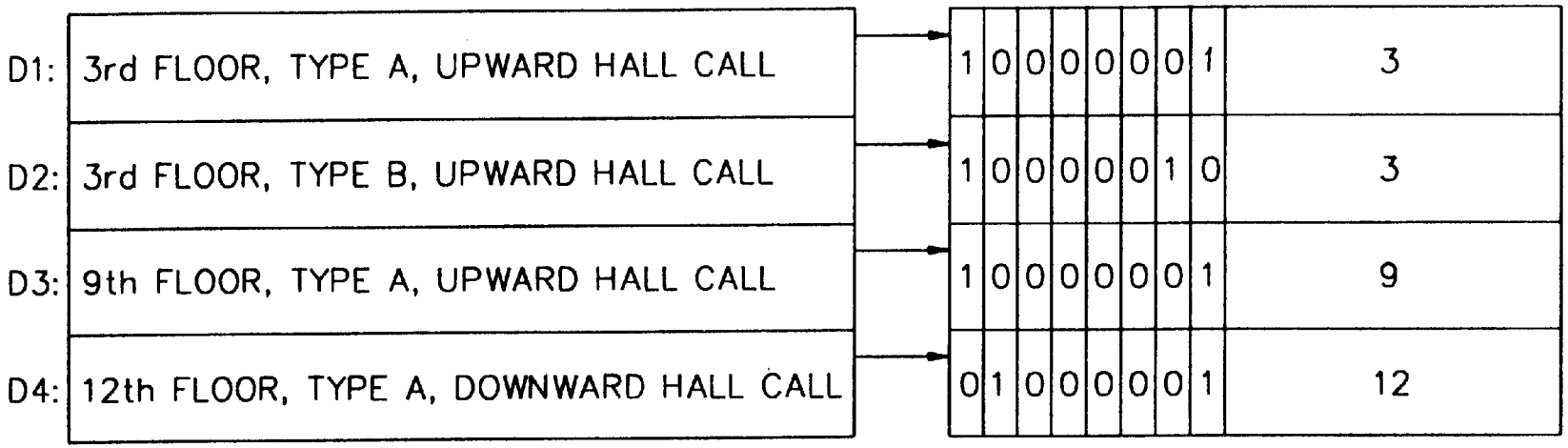
FIG. 9 is a diagram illustrating data which are generated in accordance with a plurality of hall calls according to the present invention.

The format of data D1–D4 in accordance with the above described assumptions is as shown in FIG. 9. And, the data D1–D4 are stored in the sub receiving table 34B in accordance with the data integrating unit 33 by which the steps (SA1, SA2, and SA3) of FIG. 4 are performed. Also, the steps (SB1 and SB2) of FIG. 5 are performed when an integrated cycle which is stored in the management table 35 starts.

First, the first data D1 is registered in the communication record via the steps (SC2, SC3, SC4, and SC5) of FIG. 6. With respect to the second data D2, the steps (SC6 and SC7) are performed via the steps (SC2, SC3, and SC4). That is, the data D1 and D2 have identical "the floor number" and "the operating direction of the cage" but different "the button kind", therefore only "the button kind" is additionally set to the data D2.

Also, the third and fourth data D3 and D4 are registered in the communication record via the steps (SC2, SC3, SC4, and SC5) of FIG. 6.

Figure 10:
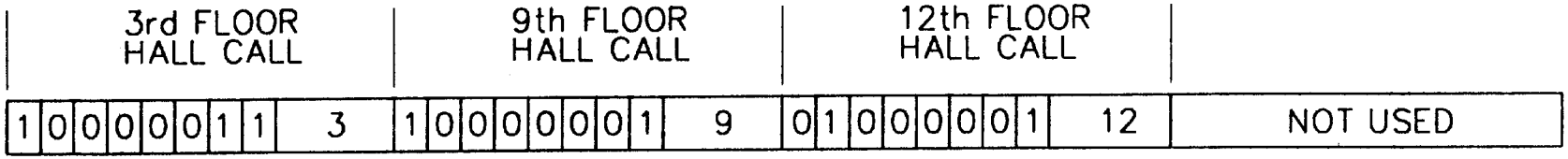
FIG. 10 is a diagram illustrating the structure of the communication record wherein the data of FIG. 9 are integrated.

As shown in FIG. 10, the communication record consists of three data, thereby completing the registration, and is transmitted to the group management controller 1 and the plurality of cages 2A–2K through the main network NETm.

FIGS. 10A and 10B are diagrams illustrating the structure of integrated data units, FIG. 10A illustrating an integrated data unit representing data received from plural hall controllers having similar attributes such as the data shown in FIG. 10, and FIG. 10B illustrating an integrated data unit representing data based on data for managing and controlling the plural elevator cages.

As described above, the number of data transmitted to the main network NETm becomes one less than the number of data received from the hall controllers 4A–4N and 5A–5N.

Figure 11A:
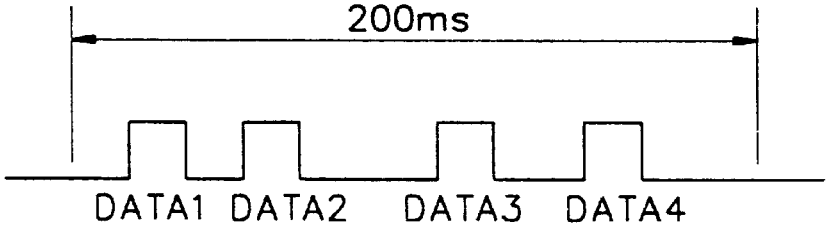
FIG. 11A is a diagram illustrating an output time of data according to the present invention and FIG. 11B is an output time of data according to the conventional art.

As shown in FIG. 11A, it takes 10 ms to transmit the communication record by the hall data integrating unit 30 within 200 ms.

Figure 11B:
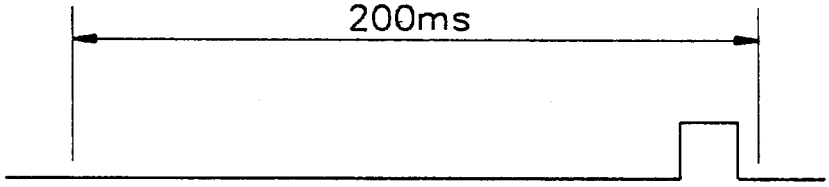

According to the conventional art, the data which are set up according to the above assumptions are sequentially transmitted one by one, so that the transmissions are performed for four times within 200 ms, and the time which the above data are transmitted is 40 ms, as shown in FIG. 11B.

However, according to the present invention, the operation which the data outputted from the plurality of hall controllers 4A–4N and 5A–5N are processed is described. Also, the operation which data outputted from the group management controller 1 and the plurality of the cages 2A–2K are processed are identical with the above described operation.

As described above, the apparatus for controlling data transmitting/receiving of the group management system of the elevator according to the present invention sequentially receives the data which are inputted through the main network connected with the group management controller 1 and the plurality of cages 2A–2K, or the data which are inputted through the sub network connected with the plurality of hall controller 4A–4N and 5A–5N, for a predetermined time, makes a predetermined communication record on the basis of the inputted data, and outputs the communication record, thereby capable of decreasing the communication load fact of the main network and obtaining the communication stability.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. An apparatus for controlling data transmission to and from a group management system of an elevator system including a plurality of cages, the apparatus comprising:

a group management controller constructed and arranged to manage and control operation of the plurality of cages;

a plurality of hall controllers constructed and arranged to control buttons and lamps of plural respective halls; and a hall data integrating unit constructed and arranged to integrate data outputted from said plurality of hall controllers for a predetermined cycle so as to form a first integrated data unit representing data received from plural hall controllers having similar attributes, transmit the integrated data from said plurality of hall controllers to said group management controller and the plurality of cages through a main network, integrate data outputted from at least one of said group management controller and the plurality of cages for a predetermined cycle so as to form a second integrated data unit representing data based on data for managing and controlling the operation of plural elevator cages, and transmit the integrated data from said group management controller and the plurality of cages to said plurality of hall controllers through a sub network, wherein the first integrated data unit includes data representing the similar attributes from the plural hall controllers coupled with data representing different attributes from those plural hall controllers, and wherein the second integrated data unit includes data representing similar attributes of the elevator cages coupled with data representing different attributes of those elevator cages, and wherein the first integrated data unit has a size no greater than a size of a data unit received from one of the hall controllers, and the second integrated data unit has a size no greater than a size of a data unit required to manage and control a single one of the elevator cages.

2. The apparatus of claim 1, wherein said hall data integrating unit comprises:

a main data receiving unit for receiving data from said hall group management controller and the plurality of cages;

a sub data receiving unit for receiving data from said plurality of hall controllers;

a data integrating unit for receiving data outputted from the main and sub data receiving units, respectively, and integrating said data in accordance with a predetermined integrated cycle;

a receiving table provided with a main receiving table for storing data processed in said data integrating unit via said main data receiving unit, and a sub receiving table for storing data processed in said data integrating unit via said sub data receiving unit;

a main data transmitting unit for outputting the data integrated by said data integrating unit to said main network;

a sub data transmitting unit for outputting the data integrated by said data integrating unit to said sub network; and a management table for storing the integrated cycle.

3. A method for controlling data transmission to and from a group management system of an elevator system including a plurality of cages, the method comprising:

sequentially storing data received from a group management controller for managing and controlling the operation of the plurality of cages through a main network, or data received from a plurality of hall controllers through a sub network;

generating a communication record by integrating the inputted data for a predetermined time and storing the communication record in a main data receiving unit or a sub data receiving unit, where the communication record includes a size no greater than a size of a data unit received from one of the hall controllers when the inputted data is received through the main network for managing and controlling the operation of the plurality of cages, and the communication record has a size no greater than a size of a data unit required to manage and control a single one of the elevator cages when the inputted data is received from the plurality of hall controllers through the sub network; and transmitting the communication record to the main or sub network.

4. The method of claim 3, wherein said step of sequentially storing comprises:

storing the received data in a sub receiving table if the received data is transmitted from the main network; and storing the received data in a main receiving table if the received data is transmitted from the sub network.

5. The method of claim 3, wherein said step of generating the communication record comprises integrating the data inputted for a preset integrated cycle in said step of sequentially storing.

6. The method of claim 3, wherein said step of generating the communication record comprises dividing the stored inputted data in accordance with "an operating direction of a cage", "a floor number which a call is generated", and "a button kind of a cage".

7. The method of claim 6, wherein said step of generating the communication record comprises:

judging whether the data stored in said step of sequentially storing data is already registered;

wherein, if the data is already registered, checking whether "the operating direction of a cage" of currently analyzed data and the registered data is identical, and "the button kind of a cage" of the two data is different; and if the above condition is satisfied, adding a bit of "the button kind of a cage" to the registered data.

8. The method of claim 3, wherein the communication record includes data representing the similar attributes from the plural hall controllers coupled with data representing different attributes from those plural hall controllers when the inputted data is received through the main network for managing and controlling the operation of the plurality of cages, and where the communication record includes data representing similar attributes of the elevator cages coupled with data representing different attributes of those elevator cages when the inputted data is received from the plurality of hall controllers through the sub network.

9. A method for controlling data communication with a group management system of an elevator system, comprising:

forming an integrated data unit representing data received from plural hall controllers having similar attributes, the integrated data unit including data representing the similar attributes from the plural hall controllers coupled with data representing different attributes from those plural hall controllers; and transmitting the integrated data unit, wherein a size of the integrated data unit is smaller than a size of a serial combination of the data received from the plural hall controllers having similar attributes.

10. The method of claim 9, wherein a size of the integrated data unit is equal to a size of a data unit received from one of the hall controllers.

11. The method of claim 9, wherein the integrated data unit is formed based on data for managing and controlling the operation of plural elevator cages.

12. A method for controlling data communication with a group management system of an elevator system, comprising:

forming an integrated data based unit on data for managing and controlling the operation of plural elevator cages, the integrated data unit including data representing similar attributes of the elevator cages coupled with data representing different attributes of those elevator cages; and transmitting the integrated data unit from the group management system, wherein a size of the integrated data unit is equal to a size of a data unit required to manage and control a single one of the elevator cages.

13. The method of claim 12, wherein the data for managing and controlling the operation of plural elevator cages is received from the group management system.

14. An apparatus as claimed in claim 1, wherein the first and second integrated data units being exclusive of unchanged data units that are received from all controllers or that are used to manage and control elevator cages.

15. A method as recited by claim 3, wherein the communication record is exclusive of unchanged communication record is exclusive of unchanged communication records received from all controllers or used to manage and controller elevator cages.

16. A method as recited by claim 9, wherein the integrated data units are exclusive of unchanged data units received from all controllers.

17. A method as recited by claim 12, wherein the integrated data unit is exclusive of unchanged data units used to manage and control elevator cages.

* * * * *